United States Patent [19]

Thiele

[11] 4,204,975

[45] May 27, 1980

[54] METHOD AND APPARATUS FOR ENCAPSULATING RADIOACTIVELY CONTAMINATED LUMPS OR GRANULAR MATERIAL IN METAL

[75] Inventor: Dietrich Thiele, Julich-Stetternich, Fed. Rep. of Germany

[73] Assignee: Kernforschungsanlage Jülich, Gesellschaft mit beschränkter Haftung, Jülich, Fed. Rep. of Germany

[21] Appl. No.: 897,362

[22] Filed: Apr. 18, 1978

[30] Foreign Application Priority Data

Apr. 20, 1977 [DE] Fed. Rep. of Germany ..... 2717389

[51] Int. Cl.[2] ..... G21F 9/34

[52] U.S. Cl. ..... 252/301.1 W; 164/63; 164/97; 264/0.5; 422/159

[58] Field of Search ..... 252/301.1 W; 264/0.5, 264/128; 118/50.1; 427/5, 6, 217; 164/63, 97, 255, 109, 110; 422/159

[56] References Cited

U.S. PATENT DOCUMENTS

| | | | |
|---|---|---|---|
| 2,946,700 | 7/1960 | Day | 118/50.1 |
| 3,541,194 | 11/1970 | Resnick | 264/128 |
| 3,623,541 | 11/1971 | Schmitz | 164/255 |
| 3,763,292 | 10/1973 | Stradley et al. | 264/0.5 |
| 4,058,479 | 11/1977 | White et al. | 252/301.1 W |
| 4,115,311 | 9/1978 | Sump | 252/301.1 W |

FOREIGN PATENT DOCUMENTS

| | | | |
|---|---|---|---|
| 2317741 | 2/1977 | France . | |
| 1215265 | 12/1970 | United Kingdom | 252/301.1 W |

*Primary Examiner*—Benjamin R. Padgett
*Assistant Examiner*—Deborah L. Kyle
*Attorney, Agent, or Firm*—Frishauf, Holtz, Goodman & Woodward

[57] ABSTRACT

The material to be encapsulated is filled into the lower section of a metal tube above a filter layer resting on a grate, and a block of encapsulation metal is loaded into the same tube resting on a sieve that separates it from the contaminated material below. If the encapsulation metal is aluminum, the air in the tube is first replaced by an inert gas supplied through a riser pipe that connects with the tube below the grate while the air is removed through a pipe in the top cover. The central portion of the tube is then heated to melt the encapsulation metal and a vacuum is applied through the riser pipe to suck the molten metal into the mass of contaminated material, through the grate, and for some distance up the riser pipe. The connecting pipes at the top and bottom of the tube are pinched off to seal the capsule.

10 Claims, 1 Drawing Figure

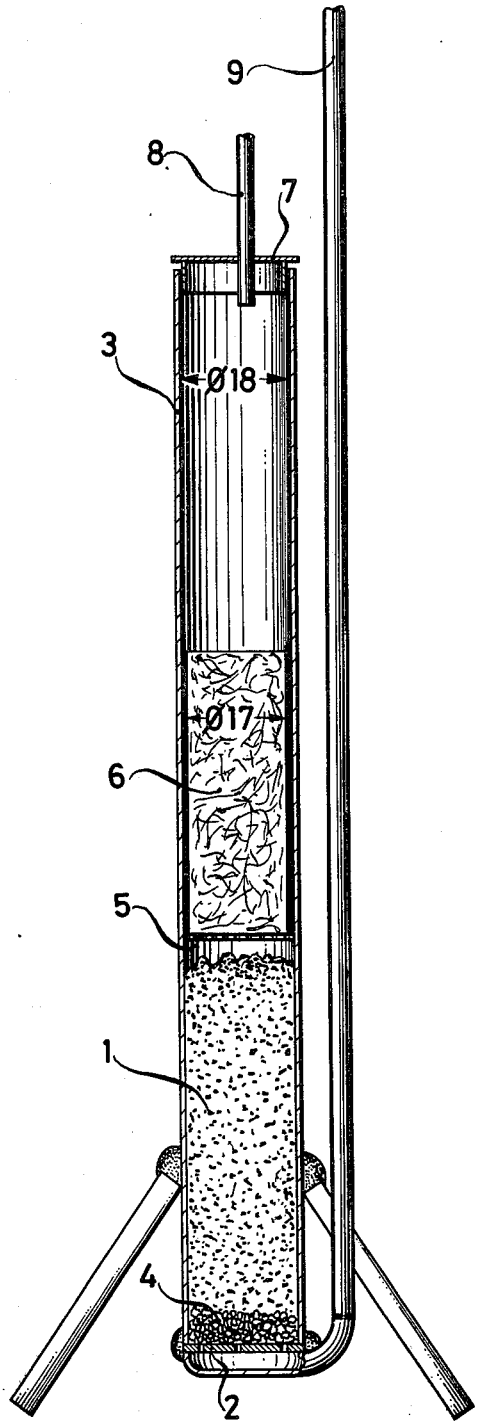
9
8
7
3
Ø18
Ø17
6
5
1
4
2

METHOD AND APPARATUS FOR ENCAPSULATING RADIOACTIVELY CONTAMINATED LUMPS OR GRANULAR MATERIAL IN METAL

This invention concerns a method and apparatus for encasing or encapsulating granular or lump-form radioactively contaminated material in metal by encasing the material to be encapsulated in a liquid metal phase, so that when the metal phase solidifies it forms a matrix for the material to be encapsulated.

In a series of industrial processes, particularly in the operation of nuclear reactors, a contaminated material not capable of further useful treatment is produced as a by-product which must be stored in some way which will not endanger the environment.

Processes are known that make it possible to treat the contaminated material in such a way that it can be stored for a long period in special places designed for the purpose.

Thus, there is already known a process for encasing radioactive material in glass. In this process, the radioactive substances are so mixed into the starting materials for the making of glass bodies, that the radioactive materials form a solid solution in the glass. This process is not usable in all cases, however, and particularly not if the radioactive material occurs in a carbide form (compare Atomwirtschaft Juli/August 1975 "HAW-Glaspartikel in Metallmatrix", pp. 347 to 349, by Dr. W. Heimerl).

It has already been attempted to mix radioactive materials in a metallic melt, but the disadvantage of the procedures used heretofore for carrying out such a process arise from the fact that because of the high boundary surface forces succeeded only imperfectly, whenever it was a question of introducing fine-grained material along with other material into the metal bath (compare Transactions of the American Nuclear Society, April 1975, pp. 671 to 680).

It is an object of the present invention to assure the complete embedding of contaminated material within the metal used for encapsulation even when fine-grained radioactive or otherwise contaminated material of a carbide nature is to be encapsulated. It is a further object that the process and the apparatus for the purpose should be economical and capable of being simply performed and used.

SUMMARY OF THE INVENTION

Briefly, the metal in molten condition is sucked into a loose mass or accumulation of the material to be encapsulated and is then brought to solidification by cooling. It has been found particularly effective to carry out the process by putting the filling of the material to be encapsulated within a tube extending in both directions beyond the material filling a section thereof, in such a way that one of the free surfaces of the mass of material in the tube is limited by a partition through which molten metal may pass and the other free surface is either in contact with the metal or is at a small spacing from the surface of a body of the metal. The metal in the tube is heated above its melting point, and sucked into the mass of contaminated material by vacuum as soon as it melts.

It is particularly effective to utilize aluminum as the encapsulation metal for carrying out the process. In this case, it is necessary to carry on the process by first replacing the air with an inert gas.

Instead of utilizing aluminum, it is also possible to use other metals, preferably metals of low-melting point, such as lead, tin, zinc, copper or in special cases, also silver or gold.

Apparatus suitable for carrying out the method consists of a section of tube or pipe that can be closed off at its upper end by a cap with an air removal tube, the cap being removable for inserting the filling of contaminated material, as well as a solid block of the encapsulation metal. Near the lower end of the tube there is as a support for the filling, a grate for the material to be encapsulated, below which the interior of the pipe is connected through a connecting tube with a vacuum pump. Above the grate, as further support for the filling, there is provided a layer of a granular or lump-form material that does not combine with or otherwise react with the metal or the material to be encapsulated, forming a layer which allows the liquid metal to pass through but which is impervious to the material to be encapsulated. When aluminum is utilized as the encapsulating metal, it is desirable to provide the connecting tube below the grate to be equipped with means for supplying an inert gas to the encapsulating tube.

In cases when it is necessary to take account of the possibility of the granulate, to be encapsulated, floating to the surface in the operation of the process of the invention, it is desirable to provide a sieve within the tube section covering off the material to be encapsulated against the block of the encapsulation metal charged in the tube, the sieve allowing the liquid metal to pass through while preventing the contaminated material from floating to the surface of the liquid metal.

In carrying out the process of the invention, in the apparatus provided for the purpose, it is obtained in every case that the particles of the material to be encapsulated are fully encased in the metal and are caused to be embedded in a pore-free manner in the metal matrix.

The invention is further described by way of illustrative example, with reference to the drawing, the single FIGURE of which is a side view, mostly in cross-section, of an apparatus for use in practicing the invention.

DESCRIPTION IN DETAIL

As shown in the drawing, the filling 1 of the contaminated particles to be encapsulated is located above a grate 2 in the pipe section 3 that itself is open both at the top and at the bottom, although provided with end caps as noted below. Above the grate 2, there is a layer 4 consisting of granular or lump-form material that does not combine with or otherwise react with the encapsulation metal or with the material to be encapsulated. The layer 4 allows the liquid metal to pass through it, but is impermeable for the material to be encapsulated. The layer 4 can consist of stainless steel scrap particles or of iron cuttings or, for example, of bits of oxide material. The tube 3 and its fittings are of metal, preferably corrosion resistant, at least for such portions as are intended to be stored as part of a capsule for many centuries or millenia.

For a diameter of about 18 mm. for the tube section 3 and a particle accumulation 1 of about 60 mm. in height, a layer thickness of 5 mm. has been found sufficient for the layer 4. The particle filling 1 is closed off above by a sieve 5, on which is supported a block 6, 17 mm. in diameter, of the metal to be sucked into the particle mass. The tube section 3 can be closed off at its upper end by a corrosion resistant gas tightly attachable cover cap 7 equipped with an air-removal pipe 8. Underneath the grate 2, there is a connection, through the riser pipe 9, with a vacuum pump not shown in the drawing, and likewise with means for delivering an inert gas for replacing air in the tube 3, which means are likewise not shown in the drawing.

For carrying out the method of the invention, the part of the tube section 3 in which the metal block 6 is located is heated to above the melting point of the metal of the block 6, by means of a heating apparatus not shown in the drawing. As soon as the metal block 6 is melted, the tube section 3 is put under vacuum. The rise in pressure of a manometer not shown in the drawing connected with the riser pipe 9 serves to show that the metal has melted. As the result of the pressure drop produced by evacuation, the melted metal is sucked into the filling 1. The amount of metal provided for the embedding of the contaminated particles of the filling 1 is so measured that after complete penetration of the filling 1, an adequate protective layer of pure metal will remain above the radioactive material.

The apparatus for carrying out the method of the invention can be used to advantage for encapsulating spent nuclear fuel particles of the kind used in high-temperature nuclear reactors. These particles consist of a core of uranium carbide that was encased in a three-fold coating of pyrolytic carbon, silicon carbide and pyrolytic carbon. The diameter of the uranium carbide cores thus coated was between about 400 and 500 μm. The spent nuclear fuel particles encased, according to the process of the invention, with aluminum as the matrix metal, were suitable for final storage after the riser pipe 9 and the air-removal pipe 8 had been pinched off. Instead of pinching off the tube ends, it is of course also possible to close them in some other way, for example by welding.

As shown in the drawing, the tube 3 is preferably equipped with legs such as the legs 12 and 13, so that it can be stood upright while the middle portion thereof is being heated. The drawing also shows that the metal block 6 is preferably made of slightly smaller diameter than the inner diameter of the tube 3, in this case 17 mm. for an inner diameter of 18 mm. of the tube 3, so that air removal from the top of the filling 1 can proceed without excessive obstruction by the block 6. Evacuation from both ends of the tube 3 is of course desirable, but when an inert gas is first used to replace air, it is necessary to remove the air through the pipe 8 while the inert gas is being supplied through the pipe 9. After all the air has been displaced, the metal block 6 can be heated through the tube 3 and the vacuum applied through the pipe 9.

Although the invention has been described with reference to a particular illustrative example, it will be understood that variations and modifications can be made within the inventive concept. For example, alloys may be used instead of single element metals for the encapsulation matrix. Thus, aluminum alloys, for example containing silicon, can be used, and likewise bronzes, brasses, brazing alloys and solders. Alloying is useful for providing a lower melting point.

I claim:

1. A method for encapsulating in metal radioactively contaminated material of granular or lump form, comprising the steps of:

filling a first section of the inside of a substantially vertically disposed tube with said contaminated material in such a way that one of the boundaries of the filled section of said tube is constituted by a porous partition at the bottom of the said first section capable of passing molten metal but impermeable to said granular or lump material;

placing a quantity of said metal in said tube in a second section thereof above and substantially adjacent to said first section thereof, heating said quantity of metal in said tube above the melting point of said metal and evacuating the insterstices of said filling of said first section of tube by applying suction to the bottom end of said tube so as to introduce said metal in the molten state into said filling and through said porous partition by suction, and cooling said molten metal after it has fully penetrated said first section of tube to solidify said metal and form a consolidated solid plug encapsulating said contaminated material.

2. A method as defined in claim 1 in which includes a preliminary step of preparing said partition by forming a layer on a grate support in said container, which layer consists of granular or lump material that is inert with respect to said metal and with respect to said contaminated material.

3. A method as defined in claim 1 in which said metal is selected from the group consisting of lead, tin, zinc, copper, gold and silver and alloys of two or more thereof, and aluminum and alloys consisting mainly of aluminum.

4. A method as defined in claim 1 in which said metal is selected from the group consisting of aluminum and alloys consisting mainly of aluminum.

5. A method as defined in claims 1, 2, or 4 in which prior to the heating, melting and suction step there is performed the step of replacing the air in said container with an inert gas.

6. A method as defined in any of claims 3 to 4 in which the step of placing said metal in said container is performed by first placing a sieve-like cover on said mass of contaminated material and then placing a solid block of said metal of lateral dimensions slightly smaller than those of said container on said cover.

7. Apparatus for producing metal-encapsulated masses of radioactively contaminated granular or lump-form material, comprising:

a container tube mounted so as to have an upper end and a lower end;

a corrosion-resistant removable cap gas-tightly attachable to the upper end of said tube for permitting admission into said tube of a mass of said contaminated material in a section of said tube and admission also of a body of an encapsulation metal above said mass, said cover being equipped with means for removing air from said tube when said cap is attached in place;

a grate across said tube near the lower end of said tube for supporting an inert layer of filter material thereon, and a gas tight connection at the lower end of said tube below said grate, with a riser pipe, for a suction connection to a vacuum pump and for allowing molten metal to rise in said pipe to an equilibrium level.

8. An apparatus as defined in claim 7 having a filter material layer on said grate composed of a granular or lump-form material which is chemically inert both with respect to said contaminated material and with respect to said encapsulation metal and of a particle size such that said layer is impermeable to said contaminated material and allows the passage of molten metal therethrough.

9. Apparatus as defined in claim 7, in which said riser pipe is connected with means for introducing inert-gas into said riser pipe and thereby into said tube.

10. Apparatus as defined in any one of claims 7, 8 or 9, in which a sieve is provided for insertion in said tube for covering contaminated material placed in the tube and for separating said material from said body of encapsulation metal, said sieve being impervious to said contaminated material but permitting passage of molten encapsulation material.

* * * * *